United States Patent [19]

Hutter et al.

[11] Patent Number: 4,664,464

[45] Date of Patent: May 12, 1987

[54] COAXIAL CABLE TERMINATION

[75] Inventors: Harold G. Hutter, Danbury; David H. Royce, Newtown, both of Conn.

[73] Assignee: Allied Corporation, Morris Township, Morris County, N.J.

[21] Appl. No.: 721,842

[22] Filed: Apr. 9, 1985

[51] Int. Cl.[4] ..... H01R 13/58

[52] U.S. Cl. ..... 339/103 R; 339/177 R; 339/276 R

[58] Field of Search ..... 339/177 R, 177 E, 103, 339/104, 276 R, 17 F, 176 MF, 14 R, 14 P, 105

[56] References Cited

U.S. PATENT DOCUMENTS

| | | | |
|---|---|---|---|
| 2,450,271 | 9/1948 | Dann | 339/103 M |
| 3,739,320 | 6/1973 | Flanagan | 339/103 R |
| 3,910,663 | 10/1975 | Winger | 339/14 R |
| 3,958,851 | 5/1976 | Evans | 339/177 E |
| 4,270,832 | 6/1981 | Tanabe | 339/105 |
| 4,397,516 | 8/1983 | Koren et al. | 339/177 R |
| 4,477,132 | 10/1984 | Moser et al. | 339/177 R |
| 4,491,381 | 1/1985 | Hameker et al. | 339/14 R |
| 4,563,051 | 1/1986 | Slackhetka | 339/177 R |

OTHER PUBLICATIONS

Thomas & Betts Product Brochures: "The Versa-Trak Undercarpet Data Cable", Data Wiring System and Cable Assembly Instructions.

Brand-Rex Company Product Sheet "Brand-Rex Data Mounts (BR DM-1, BR DM-2)".

*Primary Examiner*—Gil Weidenfeld
*Assistant Examiner*—David Pirlot
*Attorney, Agent, or Firm*—Roger H. Criss

[57] ABSTRACT

A termination system in an electrical connector for coupling a coaxial cable to a terminal member. A strain relief component includes a crimpable portion for clamping onto the insulation surrounding the conductor of the coaxial cable and an outwardly projecting portion for capturing the drain wire of the cable. The strain relief component is readily applicable for coupling a generally flat undercarpet coaxial cable in a circular connector. A circular clamp nut holds the strain relief component in the connector with the conductor terminated to the terminal member and the drain wire in engagement with the housing of the connector. An adapter is provided between the strain relief component and the circular clamp nut for adapting the flat configuration of the cable to the circular configuration of the clamp nut and connector.

22 Claims, 11 Drawing Figures

10
12
14
16
18
20
22
24
26
28
30
32
34
36
38
38a
40
42
44
46
48
52
54
56
58
59

FIG. 4
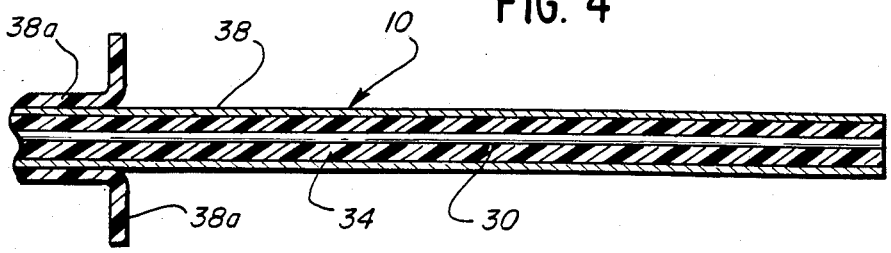
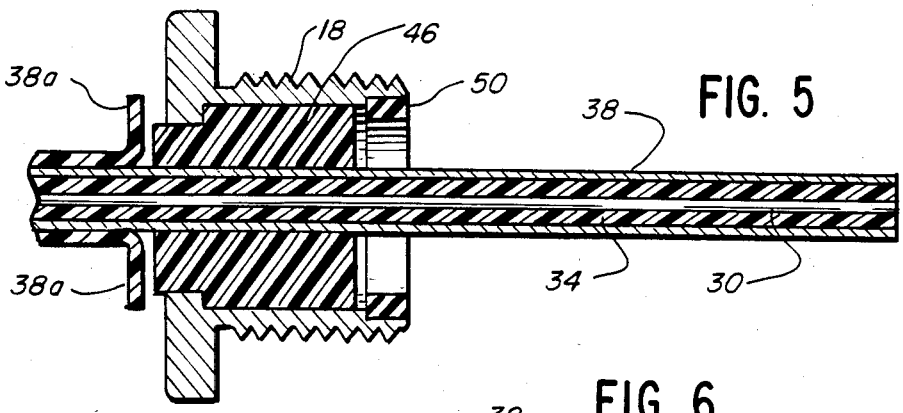
FIG. 5
FIG. 6
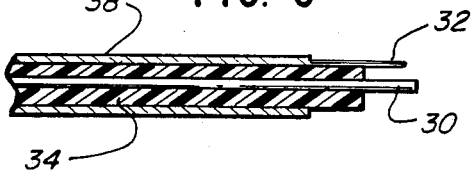
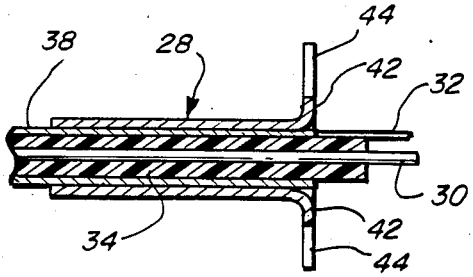
FIG. 7
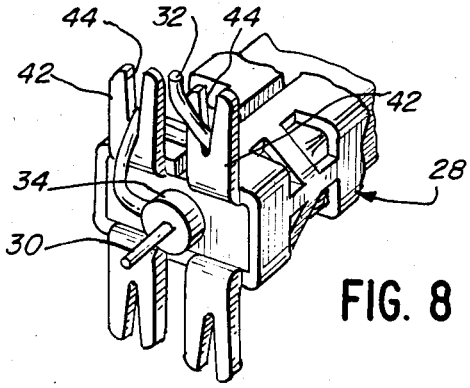
FIG. 8

FIG. 9
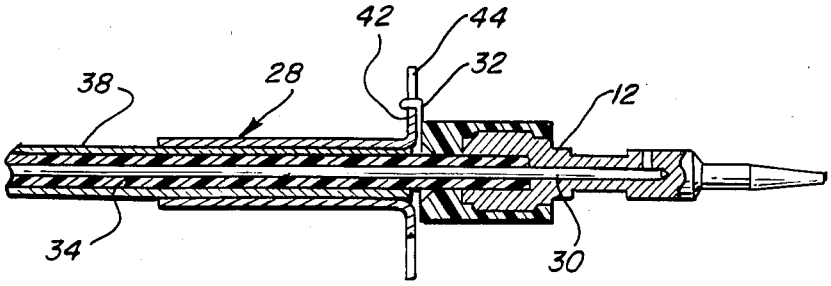
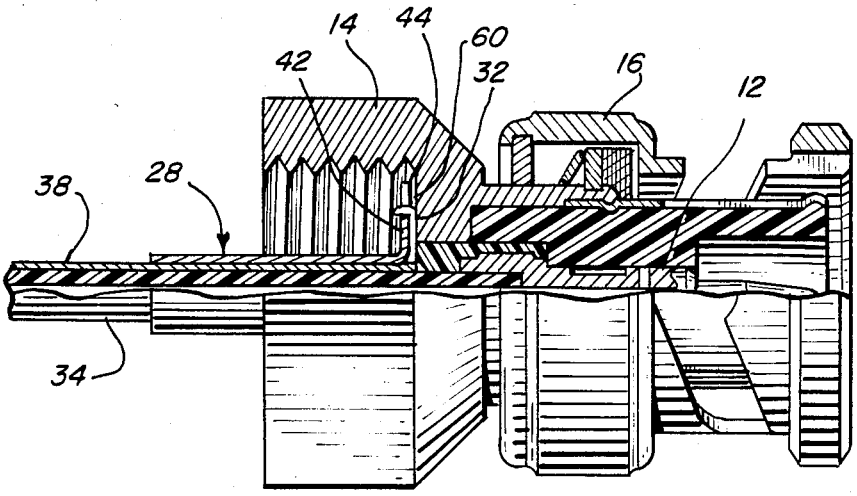
FIG. 10
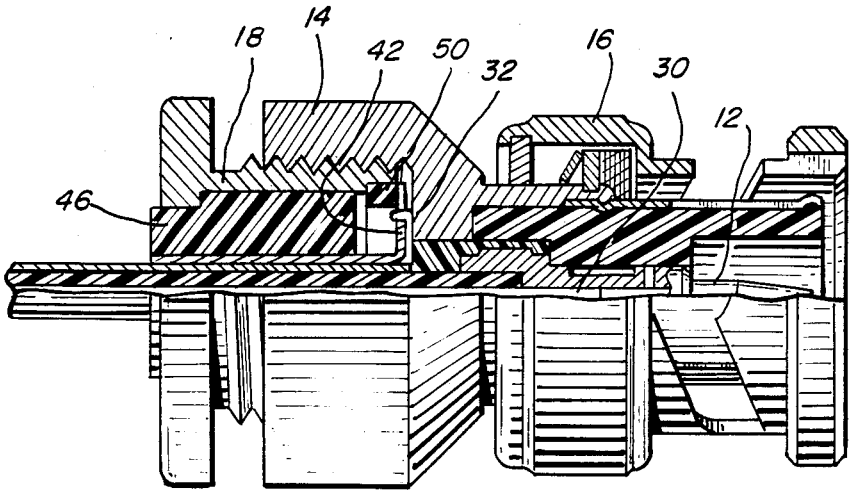
FIG. 11

COAXIAL CABLE TERMINATION

BACKGROUND OF THE INVENTION

1. Field of the Invention

This invention relates generally to the termination or interfacing of the various components of coaxial cable with an electrical connector.

2. Description of the Prior Art

A coaxial cable normally includes a center conductor, surrounded by a core, a shield or foil and a drain or ground wire, all of which are surrounded by an insulating jacket. When the cable is terminated to a connector, the insulation is stripped back or removed to expose a section of the center conductor for termination to an appropriate terminal member such as a contract. A section of the drain wire also is exposed and usually is free to be bent outwardly for engagement with a conductive portion of the connector, such as the connector housing or shell, for grounding purposes. One of the problems with such termination procedures and/or structures is that the drain wire often is not maintained in proper positioning for proper grounding.

Another problem resides in the use of coaxial cable in offices or other localities where the cable is run under carpeting or the like. This has become increasingly prevalent for undercarpet data transmission between data processing equipment. Such undercarpet cable is fabricated in a generally flat configuration and, consequently, various adapters have been designed to provide a transition from a flat or rectangular cable to a round or circular connector or other interfacing component. For instance, the rear end of standard round connectors or interfacing components have been modified for accepting the flat cable. Of course, this requires separate connector components to facilitate accommodating both flat and round coaxial cable. Often, the efficiency of field termination is adversely affected because of the inability of standard connectors or interfacing components to be readily adaptable for receiving either round or flat coaxial cable.

This invention is directed to solving the above-identified problems.

SUMMARY OF THE INVENTION

In accordance with this invention, there is provided in an electrical connector or the like for coupling a coaxial cable to a terminal member, the coaxial cable including a conductor, a drain wire and surrounding insulation, the improvement comprising a strain relief component including a crimpable portion for clamping onto the insulation surrounding the conductor of the coaxial cable and an outwardly projecting portion for capturing the drain wire of the cable, and retaining means for holding the strain relief component in the connector with the conductor terminated to the terminal member and the drain wire in engagement with the housing of the connector.

More specifically, the crimpable portion of the strain relief component comprises a crimp band for positioning about and clamping onto the surrounding insulation of the cable. In the case of flat undercarpet cable, the crimp band has a generally rectangular configuration. The outwardly projecting portion of the strain relief component comprises at least one generally radially extending finger about which the drain wire can be wrapped. The finger includes a slot in the distal end thereof for receiving and capturing the drain wire. The exemplary embodiment includes at least a pair of the slotted fingers on at least one side of the strain relief component whereby the drain wire can be positioned through the slot of one finger and readily wrapped about the other finger. This insures that the drain wire will be properly clamped in engagement with the conductive housing or shell of the connector for grounding purposes.

In further accordance with this invention, there is provided in a circular electrical connector or the like for coupling a generally flat, under-the-carpet coaxial cable to a terminal member, the coaxial cable including a conductor, a drain wire and surrounding insulation, the improvement comprising a strain relief component for clamping onto the insulation surrounding the conductor of the flat coaxial cable and a circular clamp nut for threading into the rear of the connector and holding the strain relief component in the connector with the conductor terminated to the terminal member and the drain wire in engagement with the housing of the connector.

Also in accordance with this invention, there is provided a strain relief device for clamping onto a coaxial cable to facilitate terminating the conductor of the cable to a terminal member and the drain wire of the cable to a connector component, comprising a crimpable portion for clamping onto the insulation surrounding the cable conductor, and an outwardly projecting portion for capturing the drain wire.

This invention thus provides an improved termination system for coaxial cables, including a strain relief component which positively positions, retains and holds the drain wire of the cable within the connector. The connector is readily adaptable for receiving either round or flat coaxial cable.

BRIEF DESCRIPTION OF THE DRAWINGS

FIGS. 4–11 are a sequence of views illustrating the steps in terminating a coaxial cable according to the invention.

DESCRIPTION OF THE PREFERRED EMBODIMENTS

Figures 1, 2, 3:
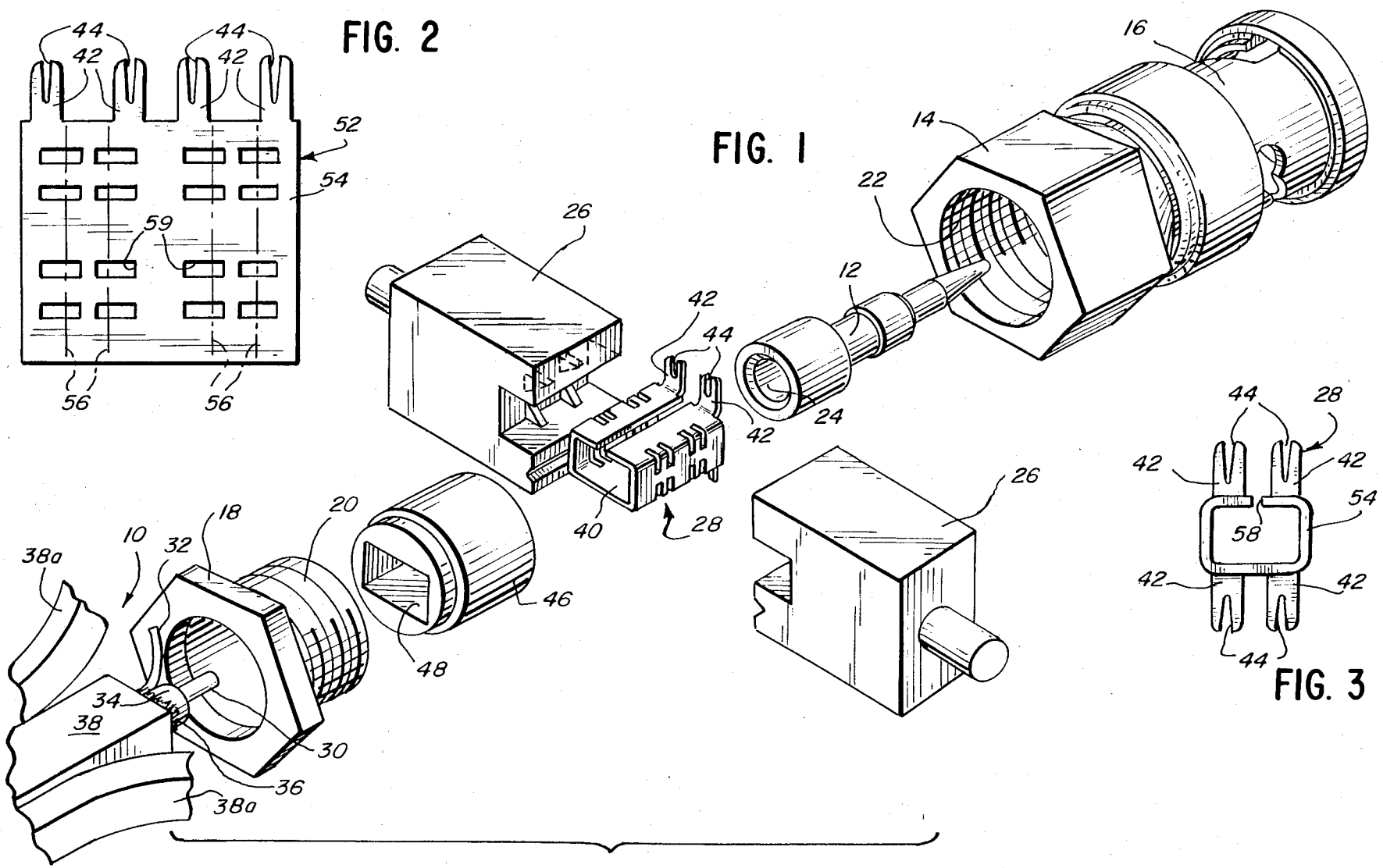
FIG. 1 is an exploded perspective view of the termination system of this invention.
FIG. 2 is a plan view, on an enlarged scale, of a blank for forming the strain relief component of the invention.
FIG. 3 is an end view of the strain relief component.

Referring to the drawings in greater detail, and first to FIG. 1, the termination system of this invention is illustrated somewhat schematically for terminating a coaxial cable, generally designated 10, to a terminal member in the form of a contact 12 received within an electrical connector which includes a shell or housing 14. It should be immediately pointed out that the connector is an industry standard BNC connector which includes housing 14, a bayonet-pin coupling ring 16 and a circular clamp nut 18 which is threaded, as at 20, for receipt within a threaded rear opening 22 of connector shell 14. In addition, terminal member 12 is an industry standard contact for a BNC connector, including a rear bore 24 for receiving the coaxial cable conductor.

FIG. 1 also schematically shows a pair of jaws 26 of an appropriate crimping tool for crimping a strain relief component, generally designated 28, of this invention as will be described in greater detail hereinafter.

Coaxial cable 10 includes a center conductor 30, a drain conductor or wire 32, a dielectric 34 and a foil shield 36, all of which are surrounded by insulation 38. The invention is readily applicable for undercarpet coaxial cable and, therefore, insulation 38 is generally flat or rectangular in configuration and defines thin wing portions 38*a* which initially are integral parts of the insulation but which may be stripped away as illustrated in FIG. 1.

Strain relief component 28 comprises an integral or unitary member and includes a generally rectangularly shaped crimp band 40 for positioning about and clamping onto insulation 38 of coaxial cable 10. The strain relief component includes at least one outwardly projecting finger 42 formed integrally with the inner end of band 40. Preferably, at least two fingers 42 are provided on at least one side of band 40. Each finger includes a slot 44 in the distal end thereof for receiving and capturing drain wire 32, as described hereinafter.

In using flat undercarpet coaxial cable, means are provided between strain relief component 28 and circular clamp nut 18 for adapting or providing transition between the flat configuration of the cable and the circular dielectric insert 46 is provided with a generally rectangular through hole or receptacle 48 sized for positioning strain relief component 28 therethrough. Insert 46 has a circular periphery for mating within the interior of circular clamp nut 18. Of course, it should be understood that clamp nut 18 itself could be fabricated initially with such an adapter or transmission means. A washer 50 (FIG. 5) is provided and sandwiched between fingers 42 of strain relief component 28 and the inner distal end of clamp nut 18.

Referring to FIG. 2, a blank, generally designated 52, is stamped to provide a configuration for forming strain relief component 28. More particularly, blank 52 includes a flat body portion 54 which can be folded or bent along lines 56 into the configuration of strain relief component 28 shown in FIGS. 1 and 3. The side edges of body portion 54, in essence, form a slot 58 in the strain relief component as illustrated in FIGS. 1 and 3. Apertures 59 are stamped out of body portion 54 of blank 52 to facilitate crimping of the strain relief component onto the insulation of the coaxial cable. It can be seen that fingers 42 are formed integral with and project from one end of body portion 54 of the blank.

FIG. 3 shows strain relief component 28 formed in its rectangular configuration from blank 52, with fingers 42 now bent generally perpendicular to body portion 54 so that the fingers project outwardly from the strain relief component.

FIGS. 4–11 illustrate the sequence of steps in terminating coaxial cable 10 to terminal member 12 and the other components of the electrical connector, by means of strain relief component 28. More particularly, FIG. 4 shows coaxial cable 10 with winged portions 38*a* of the cable stripped back to a predetermined dimension. In practice, removal of the winged portions is performed for approximately two inches (5 mm) at the end of the cable.

FIG. 5 illustrates circular clamp nut 18, adapter insert 46 and washer 50 in preassembled condition. This assembly then is positioned over the end of coaxial cable 10 until the assembly abuts against stripped wing portions 38*a* of the insulation.

FIG. 6 illustrates sections of insulation 38 and dielectric 34 removed to expose drain wire 32 and center conductor 30, respectively, to an extent sufficient to terminate the conductor within terminal member 12 and to engage the drain wire with the fingers of strain relief component 28.

FIG. 7 illustrates strain relief component 28 positioned over the insulation of coaxial cable 10 to align fingers 44 with the front edge of the insulation. The strain relief component then is crimped to the cable, as by an appropriate crimping tool such as jaws 26 (FIG. 1). Hand tools can be provided for field termination.

FIG. 8 shows a perspective view of drain wire 32 wrapped tightly about fingers 44 of strain relief component 28. More specifically, the drain wire is positioned through slot 44 in one of the fingers, then about and through the slot in the adjacent finger, until the drain wire is wrapped about the opposite side of the pair of fingers.

As shown in FIG. 10, the assembly of FIG. 9 then is inserted into the body assembly of the BNC connector which comprises housing or shell 14 and coupling ring 16, as described above. It can be seen that fingers 42 of strain relief component 28, along with drain wire 32, are in abutment with an interior shoulder 60 of connector shell 14.

The last step is illustrated in FIG. 11 wherein it can be seen that the assembly of washer 50, adapter insert 46 and circular clamp nut 18 now are brought forwardly and threaded into the rear of connector shell 14 to securely clamp strain relief component 28 within the connector. Washer 50 securely abuts against the rear of fingers 42 to securely hold drain wire 32 against connector housing 14. Of course, it should be understood that washer 50, like adapter insert 46 as described above, can be fabricated as integral parts of clamp nut 18 in order to securely clamp fingers 42 and drain wire 32 against the housing. However, the adapter insert and/or washer allows a standard clamp nut of the BNC connector to be used without requiring different clamp nuts for round and flat cables.

Thus it can be seen that this invention provides a new and improved termination system for coaxial cables, including a novel strain relief component which positively positions, retains and holds the drain wire of the cable within the circular connector. Although in the above description specific reference has been made to a BNC connector, it is apparent that this invention is applicable to other connectors as well.

What is claimed is:

1. In an electrical connector or the like for coupling a coaxial cable to a terminal member, said connector having a housing, the coaxial cable including a conductor, a drain wire and surrounding insulation, the improvement comprising a strain relief component including a crimpable portion for clamping onto the insulation surrounding the conductor of the coaxial cable and an outwardly projecting portion for capturing the drain wire of the cable, said outwardly projecting portion of said strain relief component comprising at least one generally radially extending finger about which the drain wire can be wrapped and retaining means for holding the strain relief component in the connector with the conductor terminated to the terminal member and the drain wire in engagement with the housing of the connector.

2. The connector claim 1 wherein said retaining means for holding the strain relief component in the connector comprises means for clamping said finger and the drain wire wrapped thereabout between the retaining means and the connector housing.

3. The connector of claim 1 wherein the crimpable portion of said strain relief component comprises a crimp band for positioning about and clamping onto the surrounding insulation of the cable, with said finger formed integrally with the band at one end thereof.

4. The connector of claim 1 wherein said finger includes a slot in the distal end thereof for receiving and capturing the drain wire.

5. In a circular electrical connector or the like for coupling a generally flat, under-the-carpet coaxial cable to a terminal member, the coaxial cable including a conductor, a drain wire and surrounding insulation, the improvement comprising a strain relief component for clamping into the insulation surrounding the conductor of the flat coaxial cable, a circular clamp nut for threading into the rear of the connector and holding the strain relief component in the connector with the conductor terminated to the terminal member and the drain wire in engagement with the housing of the connector and adapter means provided between the strain relief component and the circular clamp nut for adapting the flat configuration of the cable to the circular configuration of the clamp nut and connector, said strain relief component including a crimpable portion for clamping onto the insulation surrounding the conductor of a coaxial cable and an outwardly projecting portion for capturing the drain wire of the cable.

6. The connector of claim 5 wherein said adapter means includes an insert component having a generally rectangular through receptacle and a circular periphery.

7. The connector of claim 5 wherein the crimpable portion of said strain relief component comprises a crimp band for positioning about and clamping onto the surrounding insulation of the cable.

8. The connector of claim 5 wherein the crimpable portion of said strain relief component comprises a crimp band for positioning about and clamping onto the surrounding insulation of the cable, with said finger formed integrally with the band at one end thereof.

9. The connector of claim 5 wherein a forward distal end of said clamp nut effectively clamps said finger and the drain wire wrapped thereabout against an interior shoulder of the connector housing.

10. The connector of claim 5 wherein the outwardly projecting portion of said strain relief component comprises at least one generally radially extending finger about which the drain wire can be wrapped.

11. The connector of claim 10 wherein said finger includes a slot in the distal end thereof for receiving and capturing the drain wire.

12. The connector of claim 11, including at least a pair of said slotted fingers on at least one side of the strain relief component.

13. A strain relief device for clamping onto a coaxial cable to facilitate terminating the conductor of the cable to a terminal member and the drain wire of the cable to a connector component, comprising a crimpable portion for clamping onto insulation surrounding the cable conductor, and an outwardly projecting portion for capturing the drain wire, said crimpable portion of said strain relief component comprising a crimp band for positioning about and clamping onto the surrounding insulation of the cable, and said outwardly projecting portion of said strain relief component comprising at least one generally radially extending finger about which the drain wire can be wrapped.

14. The strain relief device of claim 13 wherein the crimpable portion of said strain component comprises a crimp band for positioning about and clamping onto the surrounding insulation of the cable, with said finger formed integrally with the band at one end thereof.

15. The strain relief device of claim 13 wherein said finger includes a slot in the distal end thereof for receiving and capturing the drain wire.

16. The strain relief device of claim 15, including at least a pair of said slotted fingers on at least one side of the strain relief component.

17. The strain relief device of claim 15 wherein said crimp band has a substantially rectangular shape to clamp onto a substantially rectangular-shaped insulation portion of said coaxial cable.

18. In an electrical connector or the like for coupling a coaxial cable to a terminal member, said connector having a housing, the coaxial cable including a conductor, a drain wire and surrounding insulation, the improvement comprising a strain relief component including a crimpable portion for clamping onto the insulation surrounding the conductor of the coaxial cable and an outwardly projecting portion for capturing the drain wire of the cable, said outwardly projecting portion of said strain relief component comprising at least one generally radially extending finger about which the drain wire can be wrapped and retaining means for holding the strain relief component in the connector with the conductor terminated to the terminal member and the drain wire in engagement with the housing of the connector, said retaining means for holding the strain relief component in the connector comprising means for clamping said finger and the drain wire wrapped thereabout between the retaining means and the connector housing.

19. The connector of claim 4, including at least a pair of said slotted fingers on at least one side of the strain relief component.

20. The connector of claim 19, including a pair of said slotted fingers on two sides of said strain relief component.

21. The connector of claim 1 wherein the crimpable portion of said strain relief component comprises a crimp band for positioning about and clamping onto the surrounding insulation of the cable.

22. The connector of claim 21, wherein said strain relief component has a substantially rectangular shape to clamp onto a substantially rectangular-shaped insulation portion of said coaxial cable.

* * * * *